US005553455A

United States Patent [19]

Craig et al.

[11] Patent Number: 5,553,455

[45] Date of Patent: Sep. 10, 1996

[54] HYBRID CERAMIC ARTICLE

[75] Inventors: Harold M. Craig; Otis Y. Chen, both of West Hartford, Conn.

[73] Assignee: United Technologies Corporation, Hartford, Conn.

[21] Appl. No.: 136,307

[22] Filed: Dec. 21, 1987

[51] Int. Cl.[6] ..... F42C 7/00

[52] U.S. Cl. ..... 60/753; 428/49

[58] Field of Search ..... 428/49; 60/753

[56] References Cited

U.S. PATENT DOCUMENTS

| | | | |
|---|---|---|---|
| 2,135,118 | 4/1936 | Stewart | 52/390 |
| 2,548,485 | 1/1947 | Lubbock | 263/44 |
| 2,686,655 | 12/1949 | Schorner | 253/77 |
| 3,918,255 | 11/1975 | Holden | 60/753 |
| 3,950,908 | 4/1976 | Van Evk | 52/389 |
| 3,956,886 | 5/1976 | Sedgwick | 60/39.69 |
| 3,981,142 | 9/1976 | Irwin | 60/753 |
| 4,124,732 | 11/1978 | Legan | 428/77 |
| 4,338,368 | 7/1982 | Lovelace et al. | 428/212 |
| 4,341,826 | 7/1982 | Prewo et al. | 428/35 |
| 4,422,300 | 12/1983 | Dierberger et al. | 60/753 |
| 4,428,763 | 1/1984 | Layden | 65/4.21 |
| 4,441,324 | 4/1984 | Abe et al. | 60/753 |
| 4,450,664 | 5/1984 | McNamee | 52/384 |
| 4,596,024 | 10/1985 | Brown | 428/44 |
| 4,698,249 | 10/1987 | Brown | 428/44 |
| 4,713,275 | 12/1987 | Riccitiello et al. | 428/76 |
| 4,777,844 | 10/1988 | DeBell et al. | 74/579 R |
| 4,821,478 | 4/1989 | Crema et al. | 52/384 |
| 4,849,276 | 7/1989 | Bendig et al. | 428/117 |
| 5,304,633 | 8/1994 | van der Loo et al. | 428/114 |
| 5,331,816 | 7/1994 | Able et al. | 60/753 |
| 5,362,560 | 11/1994 | Ehrhart et al. | 428/343 |

*Primary Examiner*—Stephan J. Lechert

[57] ABSTRACT

A hybrid ceramic article for high temperature applications is disclosed. The thermal barrier comprises an array of refractory ceramic tiles embedded in a fiber reinforced glass-ceramic matrix composite structure. The hybrid ceramic article exhibits high thermal stability and elevated temperature load bearing ability. A combustor liner and a combustor liner panel for a gas turbine engine and also disclosed.

14 Claims, 2 Drawing Sheets

FIG. 1
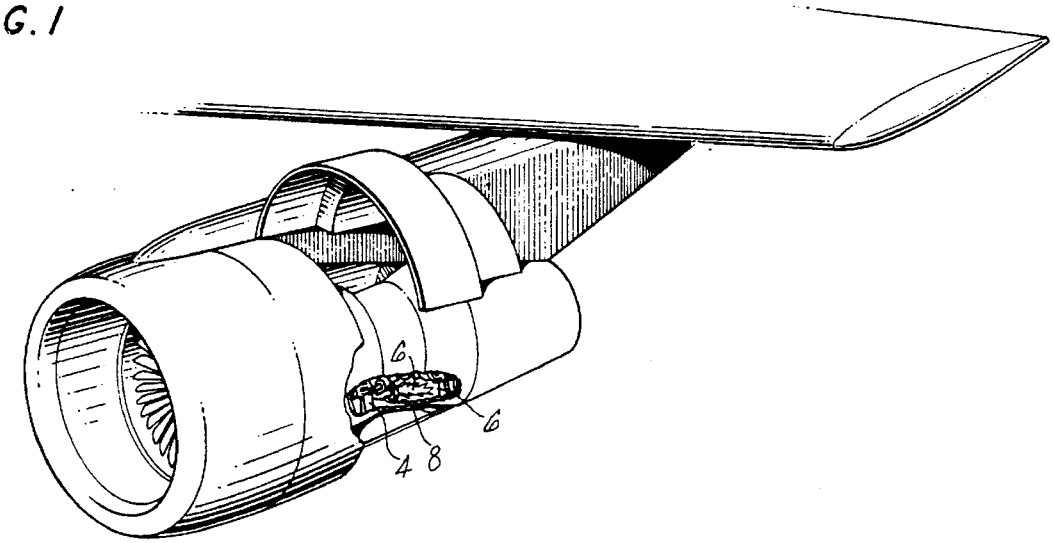
FIG. 2
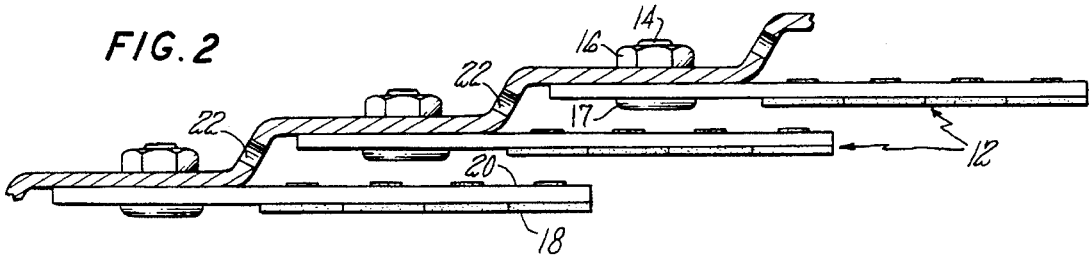
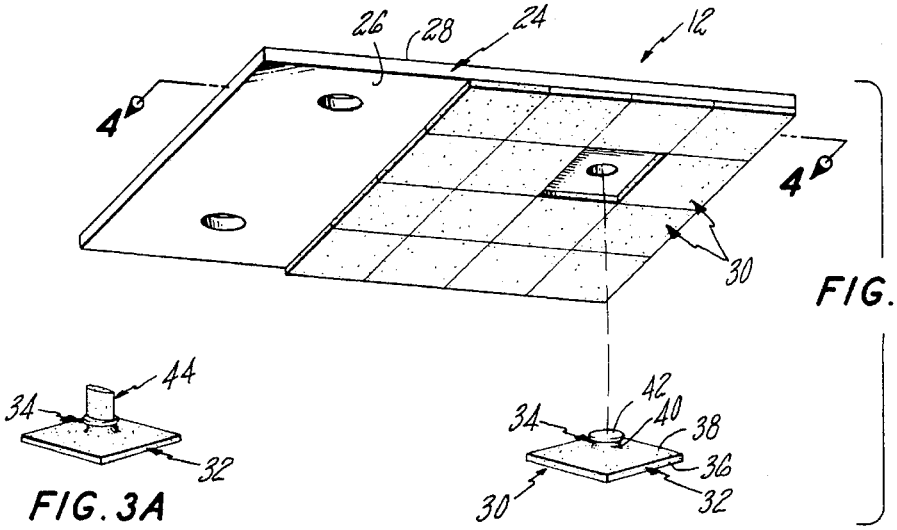
FIG. 3
FIG. 3A

HYBRID CERAMIC ARTICLE

CROSS REFERENCE TO RELATED APPLICATION

This invention is related to the invention disclosed in copending patent application Ser. No. 07/136,306 filed Dec. 21, 1987 entitled "A Process for Making a Hybrid Ceramic Article" filed by Otis Y. Chen, Harold M. Craig, Glenn M. Allen and David C. Jarmon on even date and assigned to the same assignee as this application.

TECHNICAL FIELD

This invention relates to ceramic materials and articles made therefrom.

BACKGROUND ART

The operating environment of the combustor of a high performance gas turbine engine is characterized by a number of hostile features. The combustor is exposed to the highest temperatures in the entire engine with local gas temperatures approaching 3,500° F. Rapid and wide ranging thermal excursions during heat up and cool down of the engine result in the cyclic exposure of combustor components to thermal shock and to high thermal stresses. At operating temperature, the combustor liner must support a steep thermal gradient across the liner from the hot inner surface to the cooler outer surface. Although the combustor does not experience a high mechanical load, the large thermal distortion of the components under operating conditions requires that the combustor exhibit elevated temperature load-carrying ability. In addition, the combustor is subjected to hot corrosive gases which chemically attack and mechanically erode the combustor wall.

Advanced gas turbine designs have pushed the state of the art in temperature capability of metallic components to what appears to be a point of diminishing returns. New and exotic metal alloys can withstand higher temperatures than ever before, but are extremely expensive and contain strategic elements which are remarkably scarce. The highest performance combustor liners are limited to a surface temperature of about 2,200° F. A high flow rate of cooling air must be directed over the metal alloy combustor liner surface during the operation of the turbine to ensure that the combustor wall temperature does not exceed the limitations of the metal alloy.

Ceramic materials are attractive materials for high temperature applications due to their characteristic high thermal stability. However, the use of ceramic materials in structures such as combustor burner liners has been severely limited by factors including fabrication development problems, the lack of fracture toughness that characterizes ceramic materials, and the extreme sensitivity of ceramic materials to internal flaws, surface discontinuities, and contact stresses. Conventional ceramic materials are thus prone to catastrophic failure when subjected to the thermal and mechanical stresses which characterize the combustor environment. Ceramic debris from a failed ceramic combustor liner can have catastrophic effects on downstream structures, such as turbine vanes or blades.

What is needed in this art is a combustor liner which overcomes the problems discussed above.

DISCLOSURE OF THE INVENTION

A hybrid ceramic article is disclosed. The hybrid ceramic article comprises a fiber reinforced glass matrix composite substrate and an array of refractory ceramic tiles substantially covering the surface of the substrate to thermally insulate the substrate. Each of the tiles has a protective region covering a surface of the substrate and a supportive region extending backward from the protective region and embedded in the substrate to lock the tile to the substrate. The thermal barrier exhibits high thermal stability and elevated temperature load bearing ability.

A combustor liner panel for a gas turbine engine is also disclosed. The combustor liner panel comprises a fiber reinforced glass refractory composite substrate and an array of refractory ceramic tiles substantially covering a surface of the substrate to thermally insulate the substrate. A combustor liner for a gas turbine engine is also disclosed. The combustor liner comprises an array of axially overlapping combustor liner panels covering the interior surface of a metallic combustor liner shell and fastened to the metallic combustor liner shell.

The foregoing and other features and advantages of the present invention will become more apparent from the following description and accompanying drawings.

BRIEF DESCRIPTION OF DRAWINGS

FIG. 1 shows a perspective view of a gas turbine engine, partially broken away to show a portion of the combustor.

FIG. 2 shows a cross section of a portion of a combustor.

FIG. 3 shows a partially exploded perspective view of a combustor liner panel.

FIG. 3A shows an alternative embodiment of a refractory ceramic tile.

BEST MODE FOR CARRYING OUT THE INVENTION

Figure 4:
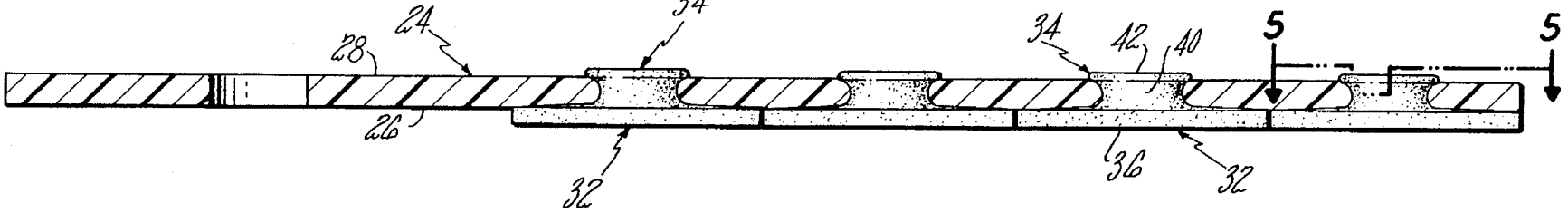
FIG. 4 shows a cross section across line 4—4 of FIG. 3.

FIG. 1 shows a perspective view of a gas turbine engine, partially broken away to show a portion of the combustor 2. The combustor includes an intake end 4 and an exhaust end 6. A fuel mixture is introduced at the intake end 4 and undergoes combustion to within the combustor 2 to produce a stream of exhaust gas. The exhaust gas exits the exhaust end 6. The inner surface of the combustor 2 is lined with a temperature resistant combustor liner 8.

FIG. 2 shows a cross section of an upper portion of the combustor liner 8. The combustor liner 8 includes a metallic shell 10 and an array of axially overlapping combustor liner panels 12 disposed to cover the inner surface of the metallic shell 10 and attached to the metallic shell 10 with bolts 14 and nuts 16. Each of the bolts 14 is positioned such that the bolt head 17 is protected from combustion gas by a combustor liner panel 12 disposed immediately upstream.

Each of the combustor liner panels includes a proximal surface 18 for exposure to the high temperature combustion gases, and a distal surface 20. The combustor liner panels 12 form a thermal barrier to protect the metallic shell 10 from the hot combustion gases. The metallic shell 10 includes cooling air ports 22. A stream of cooling air is introduced through each of the cooling air ports 22 during operation of the engine and flows across the distal surface 20 of the combustor liner panel 12.

FIG. 3 shows a perspective view of a combustor liner panel 12. The combustor liner panel 12 includes a fiber reinforced glass matrix substrate 24 which has a proximal surface 26 and a distal surface 28, and an array of refractory ceramic tiles 30 embedded in the substrate 24 and substantially covering the proximal surface 26. A tile 30 is shown in the exploded portion of FIG. 3. The tile includes a protective region 32 and a supportive region 34. The protective region 32 includes a proximal surface 36 for orienting toward the interior of the combustion chamber and an opposite distal surface 38. The supportive region 34 extends from the distal surface 38 in a direction perpendicular to the distal surface 38 and includes a stem 40 and a broadened head 42.

FIG. 3A shows an alternative embodiment of the refractory ceramic tile of the present invention and further includes a heat exchange region 44 extending from the supportive region 34. The heat exchange region 44 extends from the distal surface 28 of the substrate 24 for contact with the stream of cooling air directed over the distal surface 28 from the cooling port 22.

FIG. 4 shows a cross section along line 4—4 in FIG. 3. The protective region 32 of each tile covers a portion of the proximal surface 26 of the substrate. The stem 40 of the supportive region 38 of each tile 30 is embedded in the fiber reinforced glass matrix composite substrate 24 and the head 42 of the supportive region 34 of each tile 30 extends slightly beyond the distal surface 28 of the substrate 24 to secure the tile 30 to the substrate 24.

Figure 5:
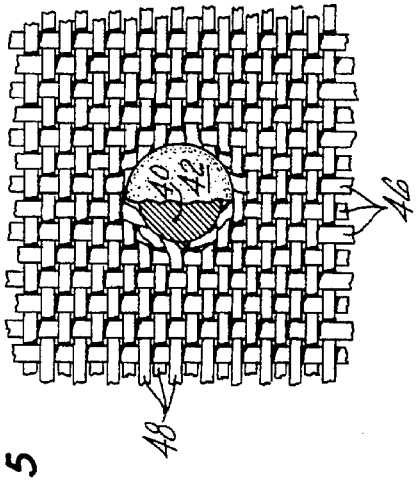
FIG. 5 shows a cross section across the line 5—5 of FIG. 3.

FIG. 5 shows a cross section across line 5—5 of FIG. 3. A cross section of the stem 40 is shown embedded between the continuous warp fibers 46 and the continuous woof fibers 48 of a woven fiber reinforced glass matrix composite substrate 24.

The matrix of the present invention may comprise any glass or glass ceramic material that exhibits resistance to elevated temperature and is thermally and chemically compatible with the fiber reinforcement of the present invention. The term "glass-ceramic" is used herein to denote materials which may, depending on processing parameters, comprise only a glassy phase or may comprise both a glassy phase and a ceramic phase. By resistance to elevated temperature is meant that a material does not substantially degrade within the temperature range of interest and that the material retains a high proportion of its room temperature physical properties within the temperature range of interest. A glass matrix material is regarded as chemically compatible with the fiber reinforcement if it does not react to substantially degrade the fiber reinforcement during processing. A glass matrix material is regarded herein as thermally compatible with the fiber reinforcement if the coefficient of thermal expansion (CTE) of the glass matrix and the CTE of the fiber reinforcement are sufficiently similar that differential thermal expansion of the fiber reinforcement and the matrix during thermal cycling does not result in delamination of the fiber reinforced glass matrix composite substrate of the present invention. Borosilicate glass (e.g. Corning Glass Works (CGW) 7740) aluminosilicate glass (e.g. CGW 1723) and high silica glass (e.g. CGW 7930) as well as mixtures of glass are examples of suitable glass matrix materials. Suitable matrices may be based on glass-ceramic compositions such as lithium aluminosilicate (LAS) magnesium aluminosilicate (MAS), calcium aluminosilicate (CAS), on combinations of glass-ceramic materials or on combinations of glass materials and glass-ceramic materials. The choice of a particular matrix material is based on the anticipated demands of the intended application. For applications in which exposure to temperatures greater than about 500° C. is anticipated, lithium aluminosilicate silicate is the preferred matrix material. Preferred lithium aluminosilicate silicate glass ceramic matrix compositions are disclosed in commonly assigned U.S. Pat. Nos. 4,324,843 and 4,485,179, the disclosures of which are incorporated by reference.

While glass or glass ceramic matrix materials are preferred, it will be appreciated by those skilled in the art that ceramic matrix materials, such as SiC or $Si_3N_4$ may also be suitable matrix materials for some applications. Ceramic matrices may be fabricated by such conventional processes as chemical vapor infiltration, sol-gel processes and the pyrolysis of organic precursor materials.

The fiber reinforcement of the present invention may comprise any fiber that exhibits high tensile strength and high tensile modulus at elevated temperatures. Suitable fibers include silicon carbide (SIC) fibers, silicon nitride ($Si_3N_4$) and refractory metal oxide fibers. Silicon carbide fibers and silicon nitride fibers are preferred. Nicalon ceramic grade fiber (Nippon Carbon Co.) is a silicon carbide fiber that has been found to be especially suitable for use with the present invention. Nicalon ceramic grade fiber is available as a multifilament silicon carbon yarn with an average fiber diameter of about 10 microns. The average strength of the fiber is approximately 300,000 psi and the average elastic modulus is approximately $32\times10^6$ psi.

The fiber reinforcement in the glass ceramic matrix of the present invention are combined so as to produce a fiber reinforced glass ceramic matrix composite substrate 24 which exhibits a high load bearing ability at elevated temperatures, high resistance to thermal and mechanical shock, high resistance to fatigue, as well as thermal compatibility with the refractory ceramic tiles of the present invention. It is preferred that the fiber reinforcement comprises a volume fraction of between about 20% and about 60% of the fiber reinforced glass ceramic matrix composite substrate. It is difficult to obtain a proper distribution of fibers if the volume fraction of fibers is below 20%, and the shear properties of the glass ceramic matrix composite material are greatly reduced if the volume fraction of fiber exceeds about 60%. It is most preferred that the fiber reinforcement comprises a volume fraction between about 35% and about 50% of the fiber reinforced glass matrix composite substrate.

The refractory ceramic tile 30 of the present invention may comprise any ceramic material that exhibits high flexural strength, oxidation resistance, and thermal shock resistance under the operation conditions of a gas turbine engine combustor, and has a thermal expansion coefficient in the range that may be matched to the fiber reinforced glass ceramic matrix composite substrate of the present invention. Silicon carbide, silicon nitride, alumina and zirconia are preferred refractory ceramic tile materials. Silicon carbide and silicon nitride are the most preferred refractory ceramic tile materials.

The refractory ceramic tile 30 of the present invention may be fabricated by conventional means as, for example, hot pressing, cold pressing, injection molding, slip casting or hot isostatic pressing, provided the fabrication process is carefully controlled to minimize flaw formation and to enhance the reliability of the tiles. It should be noted that fabrication processes influence the physical properties as well as the shape of the tile (e.g. the highest strength typically occurs with hot pressed material, and the lowest with injection molded material). Hot pressed and machined tiles offer the most flexibility for development purposes. Slip casting and injection molding offer greater opportunities for cost reduction in a production environment.

The combustor liner panel 12 of the present invention is formed by embedding the supportive region 34 of each of an array of refractory ceramic tiles 30 in a fiber layer that is impregnated with the glass ceramic matrix material, and consolidating the fiber layer and glass matrix material to form a fiber reinforced glass ceramic matrix composite substrate 24 around the supportive regions of the tiles. The supportive regions of the refractory ceramic tiles may be embedded in the fiber layer either before or after the fiber layer is impregnated with the glass ceramic matrix material.

For example, as in the preferred embodiment shown in the Figures, the substrate 24 may be formed by laying up plies of woven fiber that have been impregnated with a powdered glass ceramic matrix composition as discussed in commonly assigned U.S. Pat. No. 4,341,826, the disclosure of which is incorporated herein by reference. The supportive region 34 of each tile 30 is preferably forced between the fibers of each ply of the woven fiber reinforcement. Alternatively, holes to accommodate the supportive regions of the tiles may be produced in the woven fiber plies before layup.

The laid up plies are then consolidated by, for example, hot pressing, vacuum hot pressing or hot isostatic pressing. For example, LAS impregnated plies may be consolidated by vacuum hot pressing at temperatures between about 1200° C. and 1500° C. at pressures between 250 psi to 5000 psi for a time period between about 2 minutes to about 1 hour, wherein a shorter time period would typically correspond to a higher temperature and pressure.

Alternatively, the fiber layer may be built up around the supportive region 34 of each tile 30 from unimpregnated fiber. The fiber layer may then be impregnated, and the glass impregnated fiber layer may be consolidated by the matrix transfer process described in commonly owned U.S. Pat. No. 4,428,763, the disclosure of which is incorporated herein by reference. The article so produced may be further consolidated by vacuum hot pressing as discussed above.

If a glass-ceramic matrix material is used and a glass-ceramic matrix is desired, the article may then be heated to a temperature between about 800° C. to about 1200° C. for a time period of between about 2 hours to about 48 hours, preferably in an inert atmosphere, to partially crystallize the matrix.

It should be noted that in the design of the combustor liner panel 12 of the present invention, it is extremely important to consider the potential affects of differential thermal expansion of the elements of the liner panel. Tailoring of the thermal coefficient of expansion of the composite substrate may be achieved by judicious choices of fiber and matrix materials and of the proportion in which they are combined. The coefficient of thermal expansion (CTE) must be traded off against other properties in fabricating the composite substrate.

The CTE of the refractory ceramic tile 30 must be higher than that of the glass ceramic matrix composite substrate 24 to obtain complete coverage of the substrate within the range of combustor operating temperatures. A full coverage at elevated temperatures can only be achieved when proper spacing between the tiles is defined at room temperature. The gaps between the tiles diminish as the temperature of the liner is increased as a result of the thermal expansion of the ceramic relative to that of the substrate. Precise tile positioning is extremely important to liner performance. If the gaps between adjacent tiles are too wide, incomplete coverage of the substrate results, while inappropriately narrow gaps may cause fracture of the tile due to the compressive forces exerted by the expanding tiles.

A preferred technique for precisely positioning the area of tiles comprises bonding the array to a sheet of metal foil. Each tile of the array is selectively positioned and secured to the foil by an adhesive. Molybdenum metal foil is preferred because of its high temperature resistance. A viscous graphite adhesive, available from Cotronics Corporation is preferred because of its low curing temperature and high temperature strength. The graphite adhesive is cured by heating, for example at 266° F. for 16 hours. After the adhesive is cured the tiles are embedded in the glass ceramic matrix impregnated fiber layer and the substrate is consolidated as discussed above. The graphite adhesive has sufficient temperature resistance to withstand the consolidation process, provided the process is carried out in an inert atmosphere. After consolidation the graphite adhesive is removed by heating in air, for example at 1100° F. for 1.5 hours.

EXAMPLE 1

SiC tiles (Sohio and Norton Co.) were machined to a configuration similar to that shown in FIG. 3. The tiles were arranged in a graphite mold. The protruding supportive region on each tile was forced between the fibers of four layers of woven Nicalon cloth. A slurry of LAS glass powder was poured over the assembly. The substrate was consolidated using the matrix transfer method and vacuum hot pressing at 1000 psi and 2462° F.

EXAMPLE 2

Nine tiles were secured at predetermined locations on a molybdenum foil using graphite adhesive. The adhesive was cured at 266° F. for 16 hours. The assembly was placed in a graphite mold and embedded in a fiber reinforced glass matrix substrate by the method of Example 1. After consolidation of the glass substrate, the graphite adhesive was removed by a burnout cycle of 1100° F. for 1.5 hours in air.

The hybrid thermal barrier of the present invention allows the beneficial properties of monolithic ceramics to be exploited in load bearing applications.

The brittle failure mechanism which characterizes ceramic materials is associated with randomly distributed flaws in the material. The probability of failure increases with the volume of a ceramic structure, as increasing the volume under stress increases the probability that a flaw is included in the volume. The present invention involves a reliable, economical means to mount an array of individual ceramic tiles. The small volume of the individual tiles makes the failure of a particular tile less probable. When failure occurs, the debris associated with the failure of a small tile does little damage to downstream structures.

The stresses to which the tiles are subjected are reduced by matching the CTE of the tile and substrate materials. The combined benefit associated with the subjecting a number of small tiles to reduce stress should allow the use of lower strength cast tiles, rather than stronger, but much more costly machined tiles.

The combustor liner of the present invention allows a higher operating temperature than conventional combustors, with combustor wall temperatures approaching local gas temperature. The higher temperature resistance of the ceramic tiles allows a reduction in the flow of cooling air.

The combustor of the present invention has a lower density than conventional metal or metal/ceramic liners. The combined effect of these benefits improves the thrust/weight ratio of the turbine engine. The high tile temperature minimizes lean blowout and restart problems.

The hybrid ceramic article of the present invention exhibits some of the physical properties which uniquely characterize monolithic ceramic materials, e.g. resistance to elevated temperature, high thermal conductivity, low electrical conductivity, yet may be used in load bearing structural applications in which the use of conventional ceramic materials is not feasible. Load bearing applications are those in which an article is subjected to mechanical stress. While the hybrid ceramic article of the present invention has been discussed primarily in terms of a single embodiment, it will be appreciated by those skilled in the art that such articles may be used in other applications, for example, turbine vanes, which require ceramic-like properties as well as high fracture toughness.

Although this invention has been shown and described with respect to detailed embodiments thereof, it will be understood by those skilled in the art that various changes in form and detail thereof may be made without departing from the spirit and scope of the claimed invention.

We claim:

1. A hybrid ceramic article, comprising a fiber reinforced glass, glass ceramic or ceramic matrix composite substrate, said substrate having a proximal surface and a distal surface, and an array of refractory ceramic tiles substantially covering the proximal surface of the substrate to thermally insulate the substrate, said tiles each having a protective region covering a section of the proximal surface of the substrate and a supportive region extending from the protective region toward the distal surface of the substrate and embedded in the substrate to secure the tile to the substrate, and said thermal barrier exhibiting high thermal stability and elevated temperature load bearing ability.

2. The hybrid ceramic article of claim 1 for use as a thermal barrier wherein the refractory ceramic tiles comprise silicon carbide or silicon nitride.

3. The hybrid ceramic article of claim 1 for use as a thermal barrier wherein the glass ceramic matrix comprises lithium aluminosilicate.

4. The hybrid ceramic article of claim 1 for use as a thermal barrier wherein the fiber reinforcement comprises silicon carbide fibers or silicon nitride fibers.

5. The hybrid ceramic article of claim 1 for use as a thermal barrier wherein the tiles each have a heat exchange region extending from the supportive region through the distal surface of the substrate for contact with a cooling medium.

6. A combustor liner panel for a gas turbine engine comprising a fiber,reinforced glass ceramic matrix composite substrate, said substrate having a proximal surface and a distal surface, and an array of refractory ceramic tiles substantially covering the proximal surface of the substrate to thermally insulate the substrate, said tiles each having a protective region covering a section of the proximal surface of the substrate and a supportive region extending from the protective region toward the distal surface of the substrate and embedded in the substrate to lock the tile to the substrate, and said combustor high thermal stability and elevated temperature load bearing ability.

7. The combustor liner panel of claim 6 wherein the refractory ceramic tiles comprise silicon carbide or silicon nitride.

8. The combustor liner panel of claim 6 wherein the glass ceramic matrix comprises lithium aluminosilicate.

9. The combustor liner panel of claim 6 wherein the fiber reinforcement comprises silicon carbide fibers or silicon nitride fibers.

10. The combustor liner panel of claim 6 wherein the tiles each have a heat exchange region extending from the supportive region through the distal surface of the substrate for contact with a cooling medium.

11. A combustor liner for a gas turbine engine, comprising:

a metallic shell having an inner surface, and an array of combustor liner panels attached to the metallic shell and disposed in an axially overlapping arrangement to cover the inner surface of the shell, said combustor liner panels each comprising a fiber reinforced glass ceramic matrix composite substrate, said substrate having a proximal surface and a distal surface, and an array of refractory ceramic tiles substantially covering the proximal surface of the substrate to thermally insulate the substrate, said tiles each having a protective region covering a section of the proximal surface of the substrate and a supportive region extending from the protective region toward the distal surface of the substrate and embedded in the substrate to lock the tile to the substrate, said combustor liner exhibiting high thermal stability and elevated temperature load bearing ability.

12. The combustor liner of claim 11, wherein the refractory ceramic tiles comprise silicon carbide or silicon nitride.

13. The combustor liner of claim 11, wherein the glass ceramic matrix comprises lithium aluminosilicate.

14. The combustor liner of claim 11, wherein the fiber reinforcement comprises silicon carbide fibers or silicon nitride fibers.

* * * * *